US005447406A

United States Patent [19]

Voss

[11] Patent Number: 5,447,406

[45] Date of Patent: Sep. 5, 1995

[54] PORTABLE TRUCK RAMP

[76] Inventor: Francis Voss, 108 N. Main St., Emerson, Nebr. 68733

[21] Appl. No.: 214,709

[22] Filed: Mar. 18, 1994

[51] Int. Cl.[6] ..... B66F 5/02

[52] U.S. Cl. ..... 414/430; 414/426; 254/8 R

[58] Field of Search ..... 414/426, 430, 537; 254/5 B, 5 C, 5 R, 8 R, 88; 280/43

[56] References Cited

U.S. PATENT DOCUMENTS

| | | | |
|---|---|---|---|
| 1,419,067 | 6/1922 | McCarthy | 414/430 |
| 2,739,849 | 3/1956 | Lynn | 280/43 X |
| 2,924,427 | 2/1960 | Larson | 414/430 X |
| 3,298,705 | 1/1967 | Neaverson et al. | 254/8 R |
| 3,806,092 | 4/1974 | Richards | 280/43 X |
| 3,871,054 | 3/1975 | Schaefer | 254/8 RX |
| 4,350,470 | 9/1982 | Murillo | 414/430 |
| 4,886,243 | 12/1989 | Trumbull | 254/8 RX |
| 5,118,081 | 6/1992 | Edelman | 254/88 |

*Primary Examiner*—Michael S. Huppert
*Assistant Examiner*—James W. Keenan

[57] ABSTRACT

A portable ramp usable to raise the wheels of an automobile, truck, trailer or the like from the floor so as to ease seeing or working on the underside of the vehicle. The ramps are mounted on wheels to make the portability easier. The wheels, in turn are hinged to the ramp so that they can be used to raise the ramp off the floor for portability or to be retracted to allow the ramp to be firmly placed on the floor. The ramp is constructed to be securely held in place as the vehicle enters it.

7 Claims, 2 Drawing Sheets

PORTABLE TRUCK RAMP

BACKGROUND AND SUMMARY OF THE INVENTION

This invention pertains to ramps onto which the wheels of a vehicle such as an automobile, motor home, truck, bus, trailer or the like may be rolled to raise the wheel and a corresponding part of the vehicle so that access to the underside of the vehicle is more easily achieved.

In the earlier days of the automobile when the opening for draining oil from the crankcase of the engine became located at the bottom of the crankcase beneath the engine, access to that facility was almost exclusively from beneath the car. It therefore became quite common for service stations to build fixed ramps for the car to be driven onto. A pair of rails at a height of 3 to 4 feet above the ground was used, with a sloping pair of tracks following the car to be driven onto the upper tracks. Then a worker could crawl beneath the car as it was elevated and remove the drain plug to drain the used crankcase oil from the engine to be later replaced by fresh oil.

Later, oil pits into which the worker would climb down became common, to be followed by elevating hoists adapted to raise the car by hydraulic or pneumatic pressure. Each of these expedients worked successfully, but all were generally beyond the budget of the usual owner of the car.

Currently, large numbers of motorists choose to do some of their own maintenance including such expedients as changing oil, checking steering gear, hydraulic brake lines, shock absorbing struts and the like. However, most jacks, because of their relatively narrow base, are inherently dangerous for giving such access. Individual wheel ramps having a much broader base are comparatively much safer in that they rarely tip over to drop the vehicle. However, in order to be strong enough to carry the wheel and that wheel's portion of the vehicle weight, the ramp must be made of a relatively heavy structure. Thus the weight makes the ramp hard to move and therefore undesirably clumsy for ordinary use.

In order to avoid the difficulty of portability of a strong enough ramp having a relatively broad base for safety, the present invention uses retractable wheels on which the ramp can be moved, and which can be retracted into the base so that, when the ramp is used, the base rests firmly on the floor. The action is completely mechanical so that no special upkeep of the retraction mechanism is necessary. Further, the cost may be kept reasonable by the use of relatively simple mechanical means.

DESCRIPTION

Briefly this invention comprises a readily portable ramp strong enough to support nearly any motor vehicle or trailer and still is portable enough to be handled by the ordinary householder.

Figure 6:
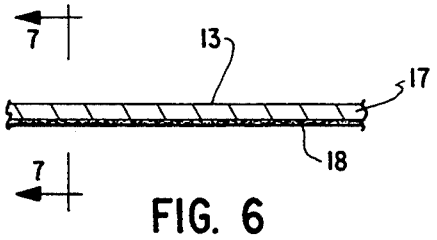
FIG. 6 is a sectional view from line 6—6 of FIG. 3 to a slightly enlarged scale.
Figure 7:
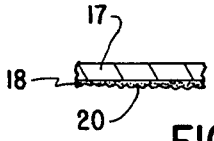
FIG. 7 is an end view from line 7—7 of FIG. 6.

Specifically and with reference to the figures, the ramp comprises a track member composed of a sloped track 10 and a platform track 11. Legs 12 support the platform 11 from a base plate 13. A similar base plate 14 extends beyond the bottom edge of the sloped track 10 and inward under that track 10 to a depending wall 15 which also supports the base plate 14 for the sloped track 10. As shown in FIG. 6 the base plates 13 and 14 are really a composite plate formed of a metal flat piece 17 and a base 18 of grooved rubber (or similar material). The metal piece 17 provides stiffening and the base 18 supplies sufficient friction to keep the ramp in place while the vehicle is being driven onto and is supported by the ramp. Grooves 20 in the base 18 allow water or oil or the like to be pressed out from under the base thus avoiding liquid-enhanced slipping.

Figures 3, 4:
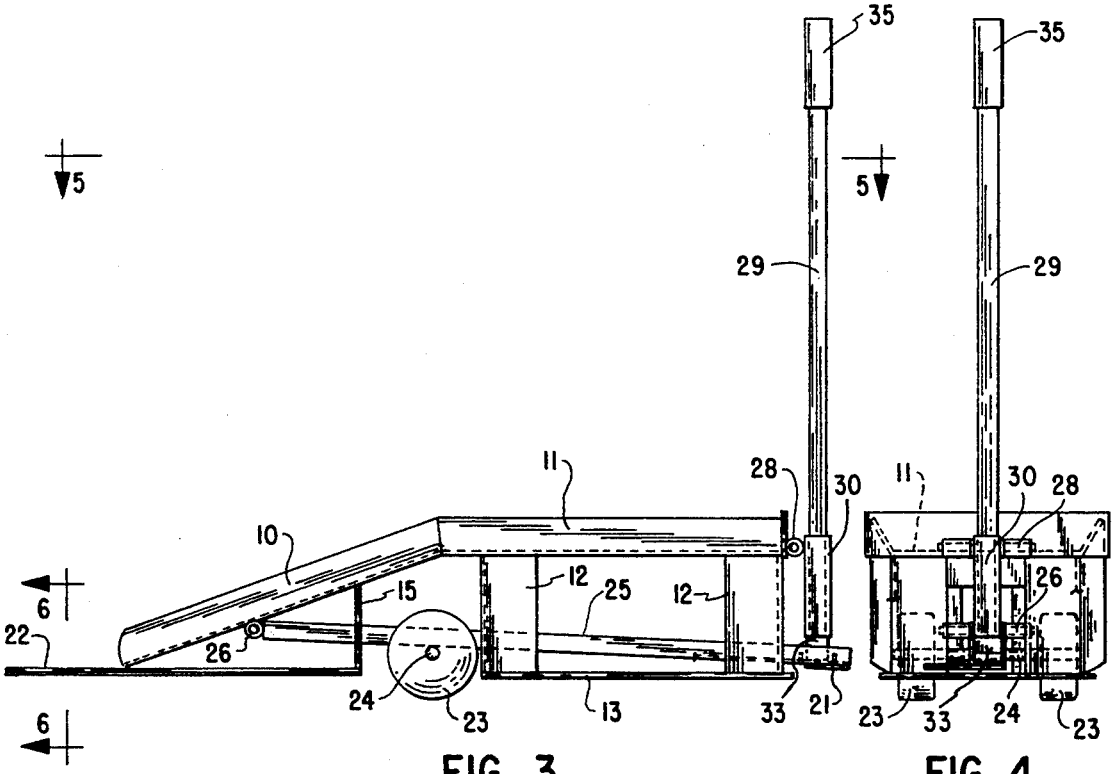
FIG. 3 is a view similar to FIG. 1 showing some added detail.
FIG. 4 is an end elevational view of the device of FIG. 3.

It is important to extend the plate 14 well beyond the front of the sloped track 10 as shown in FIG. 3. The extension 22 beyond the track provides a platform for the tire of whatever wheel is being driven onto the ramp such that the plate 14 is firmly set on the surface on which it rests so that the ramp is tightly held in place while the wheel mounts the sloped track 10.

The wheels 23 which provide the portability are journalled on an axle 24 which is fixed to a lever 25. This lever is pivotally attached to the lower surface of the sloped ramp 10 at a bracket 26. This lever 25 is a U-shaped channel member having an open side on the top. It extends from the bracket 26 to beyond the free end of the platform track 11. To provide reasonable balance of the device when it is being moved, the wheels are located about midway between the bottom end of the sloped track and the opposite end of the platform track 11. At the end of the lever 25, a pedal 21 extends somewhat laterally. This pedal provides space for foot pressure to be applied to assist in pressing the free end of the lever 25 downwardly to raise the ramp onto the wheels 23.

Figure 1:
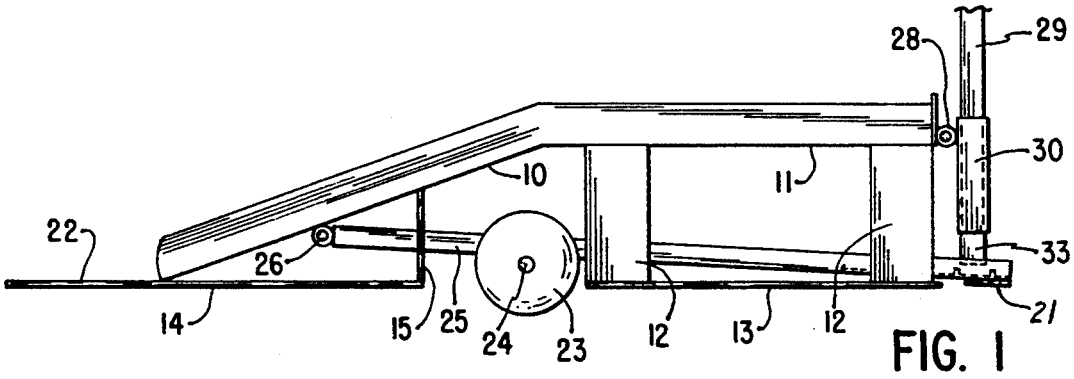
FIG. 1 is a simplified side elevational view of the ramp having the wheels extended for movement to a desired setting.
Figure 2:
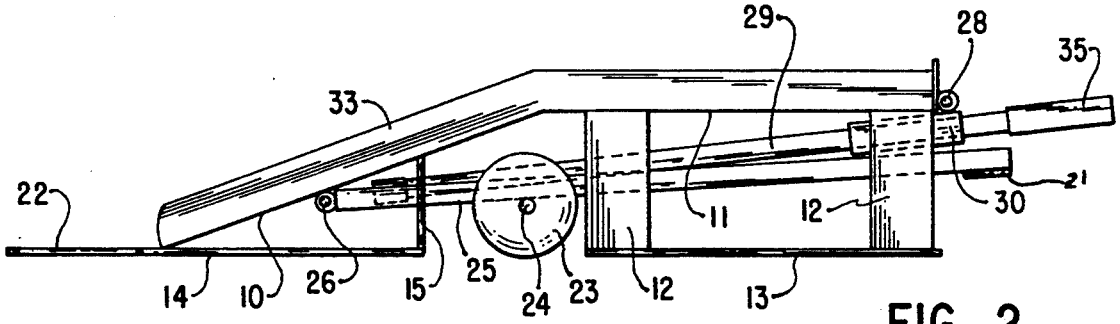
FIG. 2 is a view similar to FIG. 1 of the ramp with retracted wheels and withdrawn handles ready to be driven onto.
Figure 5:
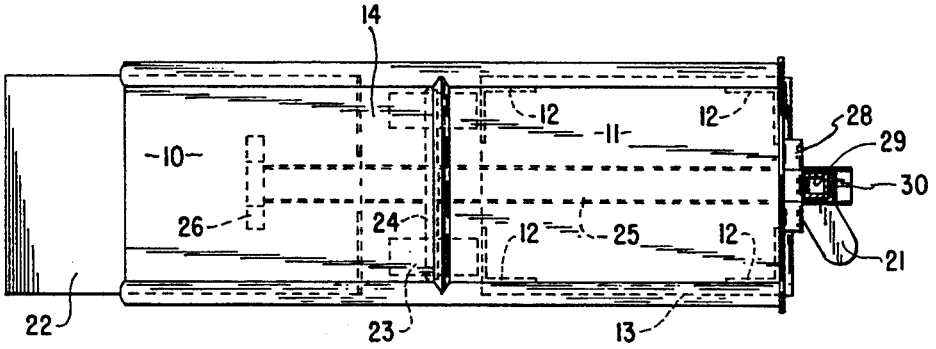
FIG. 5 is a view from line 5—5 of FIG. 3.

At that opposite end of the track 11 a second pivot bracket 28 provides a pivotal fulcrum for the prybar lever 29, which is slidably journalled in a collar 30. This collar is the part which is pivotally mounted on the bracket 28. As shown by comparing FIGS. 1 and 2, the collar 30 pivots from a use position where the axis is near vertical (FIG. 1) to a stored position with a near-horizontal axis (FIG. 2). In the stored position, the lever 29 can be slid in the collar 30 to a storage position shown in FIG. 2 where the lever is nearly entirely confined under the tracks 10 and 11.

To use the device, the lever 29 is pulled completely out to a position where a ring 33 around the end abuts the collar 30 whereupon it can be pivoted around the pivot bracket 28. That bracket is positioned so that the ring member 33 and the adjacent end of the lever 29 will press on the channel 25 to raise the ramp by a cam action relative to the wheels 23 so that those wheels support the entire assembly. During this process, the ramp may be held in place by stepping on the pedal 21. In the position where the ramp is supported by the wheels, the assembly can be rolled on the wheels and readily moved to a desired position on any flat surface. On irregular surfaces, movement will be greatly eased.

Preferably, two sloped tracks 10 will be placed immediately adjacent either the two front or two rear wheels of the vehicle which is desired to be raised. As each device is placed, the lever 29 is again pivoted to the stored position. This action allows the ramp assembly to drop relative to the wheels 25 until the base 18 is firmly set on the surface. At that point the vehicle can be driven, pulled or pushed so that the wheels adjacent the ramp will roll first onto the extension 22 to hold the ramp, then up the sloped track thus raising the vehicle for the desired access to the underside. Lowering of the vehicle requires only a reversal of the process.

For ease of handling, a grip 35 may be provided at the outer end of the lever. This grip may be knurled steel or a rubber-like material providing a firmer gripping surface.

Also, square tubing is preferred for the lever 29. This shape provides more adequate camming action with the inner surface of the channel 25 and also prevents turning of the lever relative to the collar 30 so that the assembly can be more easily steered while moving. However, it is envisioned that other cross-sectional shapes to accomplish the same purpose may be used.

I claim as my invention:

1. A portable ramp for a single wheel of a wheeled vehicle, said ramp comprising track means having a sloped part and a platform part, support means for said track means, said support means adapted to support said track means from a surface, wheel mounting means including a lever device pivotally mounted on said track means, and wheels on said lever device at a point about midway of the length of said track means, said lever device extending beyond the platform part, said wheel mounting means including a camming lever pivotally attached to said track means, said camming lever having one end adapted to press against said first named lever device to raise said track means relative to the wheels whereby said wheels can be made to support said ramp and to allow easy movement of said ramp.

wherein said camming lever is slidably engaged in a collar, said collar being pivotally attached to said platform part of said track means, said camming lever being slidable in said collar to move from a stored position under said track means to a working position in which the camming lever presses the first named lever device.

2. The ramp of claim 1 in which said first named lever device is of channel shaped cross section having two sides and a bottom, said camming lever having one end adapted to slide between said sides and to press against said bottom.

3. The ramp of claim 2 in which said first named lever device includes a pedal extending beyond said platform part of said track means, said pedal thereby being positioned to be stepped on to press said first named lever device to assist in raising said track means to be supported by said wheel means.

4. The ramp of claim 1 in which one end of said camming lever presses against said first named lever device, said one end being formed to provide a shoulder, said shoulder being engageable with said collar to limit the sliding movement of said camming lever.

5. The ramp of claim 1 in which said support means includes a base, said base including a friction inducing surface adapted to engage the supporting surface on which the ramp rests.

6. The ramp of claim 5 in which said base includes an extension reaching substantially beyond said sloped part of said track means whereby said extension is in position to be under said wheel before said wheel reaches said sloped part.

7. The ramp of claim 1 in which said lever device is extended opposite said sloped part to provide a pedal, said pedal being placed to be stepped on to press said lever device to raise said track means.

* * * * *